US012714948B1

(12) United States Patent
Wang

(10) Patent No.: US 12,714,948 B1
(45) Date of Patent: Aug. 25, 2026

(54) TOY COSMETIC BOX

(71) Applicant: Ruiqun Wang, Shantou (CN)

(72) Inventor: Ruiqun Wang, Shantou (CN)

( * ) Notice: Subject to any disclaimer, the term of this patent is extended or adjusted under 35 U.S.C. 154(b) by 0 days.

(21) Appl. No.: 19/314,307

(22) Filed: Aug. 29, 2025

(30) Foreign Application Priority Data

Aug. 12, 2025 (CN) ..... 202521719141.9

(51) Int. Cl.
*A63H 33/30* (2006.01)
*A45C 5/00* (2006.01)

(52) U.S. Cl.
CPC ..... *A63H 33/30* (2013.01); *A45C 5/005* (2013.01)

(58) Field of Classification Search
CPC ..... A63H 33/30; A45C 5/005; A45D 29/20
See application file for complete search history.

(56) References Cited

U.S. PATENT DOCUMENTS 2,119,313 A * 5/1938 Burdge ..... A45C 11/008 190/30
2,286,427 A * 6/1942 Levensten ..... B25H 3/02 312/902
4,361,981 A * 12/1982 Reiling ..... A63H 33/30 446/485
4,936,463 A * 6/1990 Tiramani ..... A45C 5/005 206/581
5,358,100 A * 10/1994 Wolff ..... A45C 5/005 206/823
6,986,355 B2 * 1/2006 Byun ..... A45D 33/006 132/294
D614,814 S * 4/2010 Lin ..... D28/83
D618,854 S * 6/2010 Lin ..... D28/83
(Continued)

FOREIGN PATENT DOCUMENTS

CA 2735679 C * 8/2016 ..... B25H 3/02
CN 201640854 U * 11/2010
CN 202987710 U * 6/2013
(Continued)

OTHER PUBLICATIONS

Translation CN204949903U (Year: 2016).*
(Continued)

*Primary Examiner* — Eugene L Kim
*Assistant Examiner* — Alyssa M Hylinski
(74) *Attorney, Agent, or Firm* — Law Offices of Sandy Lipkin; Sandy Lipkin

(57) ABSTRACT

A toy cosmetic box includes a box body, a drawer, and a plurality of storage plates. The box body defines an accommodating slot. The drawer is arranged in the accommodating slot and is slidably connected to the box body. The drawer is movable between a storage position and an extended position. All the storage plates are arranged on an upper surface of the drawer, are movably connected to the drawer, and are movable between a first position and a second position. When the drawer is at the extended position, the drawer extends out from the accommodating slot, and the storage plates are movable from the first position to the second position. When the storage plates move from the second position to the first position, the drawer is movable from the extended position to the storage position, and the storage plates and the drawer are all positioned in the accommodating slot.

18 Claims, 9 Drawing Sheets

(56) References Cited

U.S. PATENT DOCUMENTS

| | | | | |
|---|---|---|---|---|
| 8,944,537 | B1 * | 2/2015 | Manalang | B25H 3/028 312/319.2 |
| 2004/0163297 | A1 * | 8/2004 | Lin | G09F 23/00 40/640 |

FOREIGN PATENT DOCUMENTS

| | | | | | |
|---|---|---|---|---|---|
| CN | 204949903 | U | * | 1/2016 | |
| CN | 109171147 | A | * | 1/2019 | A45C 13/26 |
| CN | 211560865 | U | * | 9/2020 | |
| CN | 116059649 | A | * | 5/2023 | A63H 3/36 |
| CN | 221285348 | U | * | 7/2024 | |
| CN | 118902228 | A | * | 11/2024 | A47B 88/50 |
| GB | 2298190 | A | * | 8/1996 | A45C 13/02 |
| KR | 20090006820 | U | * | 7/2009 | A45D 33/20 |

OTHER PUBLICATIONS

Translation KR20090006820U (Year: 2009).*
Translation CN118902228A (Year: 2024).*
Translation CN221285348U (Year: 2024).*

* cited by examiner

TOY COSMETIC BOX

CROSS-REFERENCE TO RELATED APPLICATIONS

The application claims priority of Chinese patent application CN202521719141 9, filed on Aug. 12, 2025, which is incorporated herein by reference in its entirety.

TECHNICAL FIELD

The present invention relates to the field of children's toy, and more particularly, to a toy cosmetic box.

BACKGROUND ART

At present, as common toys for children to simulate cosmetic games, toy cosmetic boxes are favored by many children. However, the existing toy cosmetic boxes have following technical problems.

Firstly, the design of storage space of the existing toy cosmetic boxes is single, and the drawers are only used as simple storage containers. An upper surface of the drawers is usually designed as a flat cover or is applied with blank space design. This fails to fully utilize the upper space of the drawers. The existing toy cosmetic boxes are deficient in the design of operational interest. Most of the existing toy cosmetic boxes only provide simple opening and closing operations and lack diversified interactive operation experience. In addition, various components of the product lack an interesting linkage relation. Thus, it is impossible to drive other components to make coordinated actions through the operation of one component. This makes it difficult to stimulate children's interest in operation and their desire to explore.

SUMMARY

As for the above-mentioned problems in the existing technology, the present invention provides a toy cosmetic box. The toy cosmetic box achieves a maximum utilization of storage space and diversifies the usage methods by adopting a multi-level drawer system and a design of movable storage plates, thereby enhancing the interest and practicality of the product.

The technical solution adopted by the present invention to solve the above-mentioned technical problems is as follows. The toy cosmetic box includes a box body, and the box body defines an accommodating slot. The toy cosmetic box further includes a drawer. The drawer is arranged in the accommodating slot, and the drawer is slidably connected to the box body. The drawer is movable between a storage position and an extended position. The toy cosmetic box further includes a plurality of storage plates. All the storage plates are arranged on an upper surface of the drawer. All the storage plates are movably connected to the drawer, and all the storage plates are movable between a first position and a second position. When the drawer is at the extended position, the drawer extends out from the accommodating slot, and the storage plates are movable from the first position to the second position. When the storage plates move from the second position to the first position, the drawer is movable from the extended position to the storage position, and the storage plates and the drawer are all positioned in the accommodating slot.

Beneficial effects of the present invention are as follows. Through the above structure, when in use, a multi-level storage system is capable of meeting the need of classified storage of different objects. The linkage design between the storage plates and the drawer greatly increases the interest of operation, thereby providing children with a high-quality toy product with plentiful functions, interesting operation, and easy portability as a whole.

BRIEF DESCRIPTION OF THE DRAWINGS

Implementations of the present disclosure will now be described, by way of embodiment, with reference to the attached figures. It should be understood, the drawings are shown for illustrative purpose only, for ordinary person skilled in the art, other drawings obtained from these drawings without paying creative labor by an ordinary person skilled in the art should be within scope of the present disclosure.

DETAILED DESCRIPTION OF THE EMBODIMENTS

Figure 1:
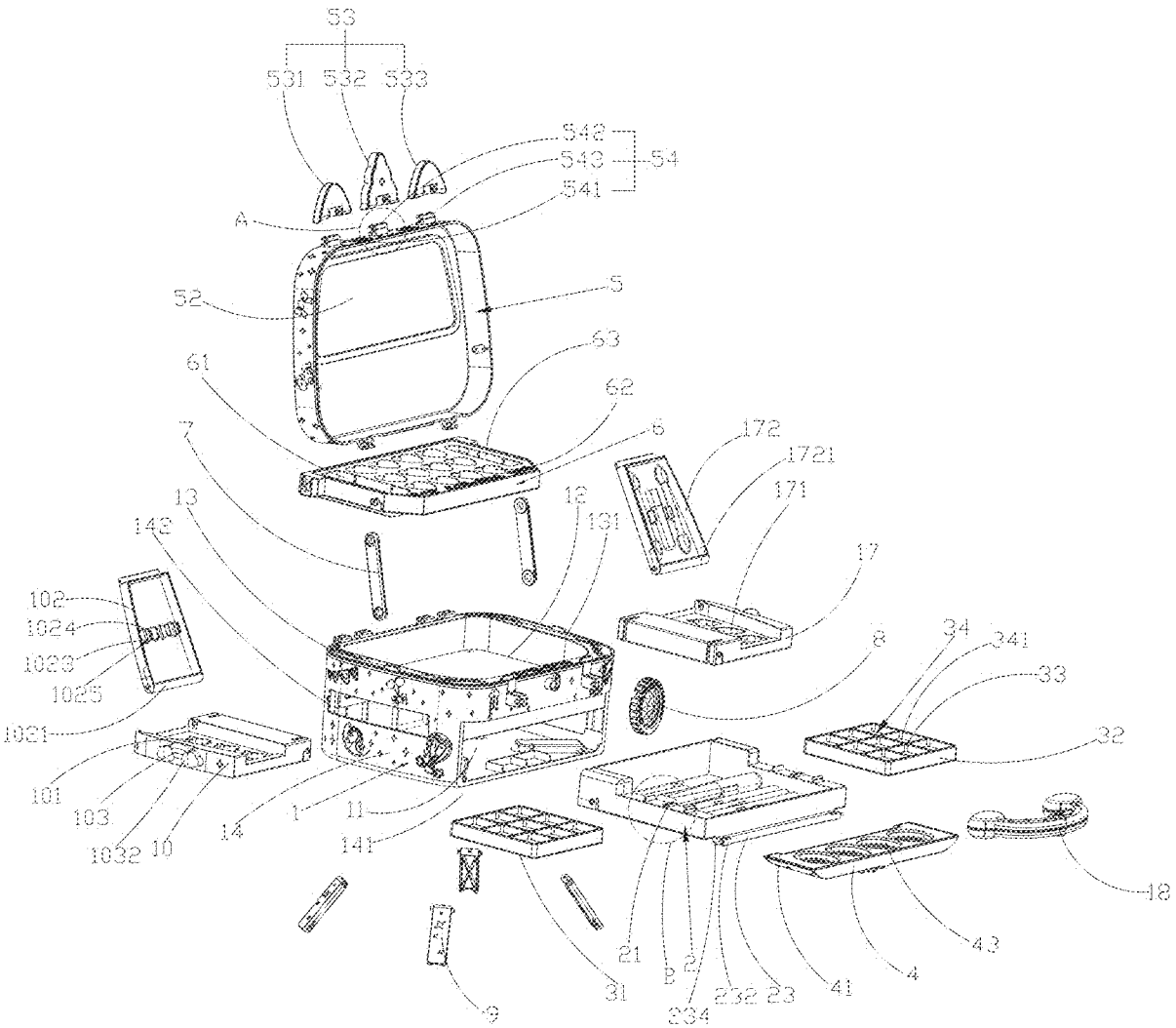
FIG. 1 is an exploded structure diagram of an angle of the present invention.

It will be appreciated that for simplicity and clarity of illustration, where appropriate, reference numerals have been repeated among the different figures to indicate corresponding or analogous elements. In addition, numerous specific details are set forth in order to provide a thorough understanding of the exemplary embodiments described herein. However, it will be understood by those of ordinary skill in the art that the exemplary embodiments described herein may be practiced without these specific details. In other instances, methods, procedures, and components have not been described in detail so as not to obscure the related relevant feature being described. Also, the description is not to be considered as limiting the scope of the exemplary embodiments described herein. The drawings are not necessarily to scale and the proportions of certain parts may be exaggerated to better illustrate details and features of the present disclosure.

The term "comprising" when utilized, means "including, but not necessarily limited to"; it specifically indicates open-ended inclusion or membership in the so-described combination, group, series, and the like. The disclosure is illustrated by way of example and not by way of limitation in the figures of the accompanying drawings in which like references indicate similar elements. It should be noted that references to "an" or "one" embodiment in this disclosure are not necessarily to the same embodiment, and such references can mean "at least one". In addition, the terms "first" and "second" are used for descriptive purposes only and cannot be understood as indicating or implying relative importance or implying the number of indicated technical features. Thus, the features defined as "first" and "second" may explicitly or implicitly include one or more of the features. In the description of embodiments of the application, "a plurality of" means two or more, unless otherwise specifically defined.

Figure 2:
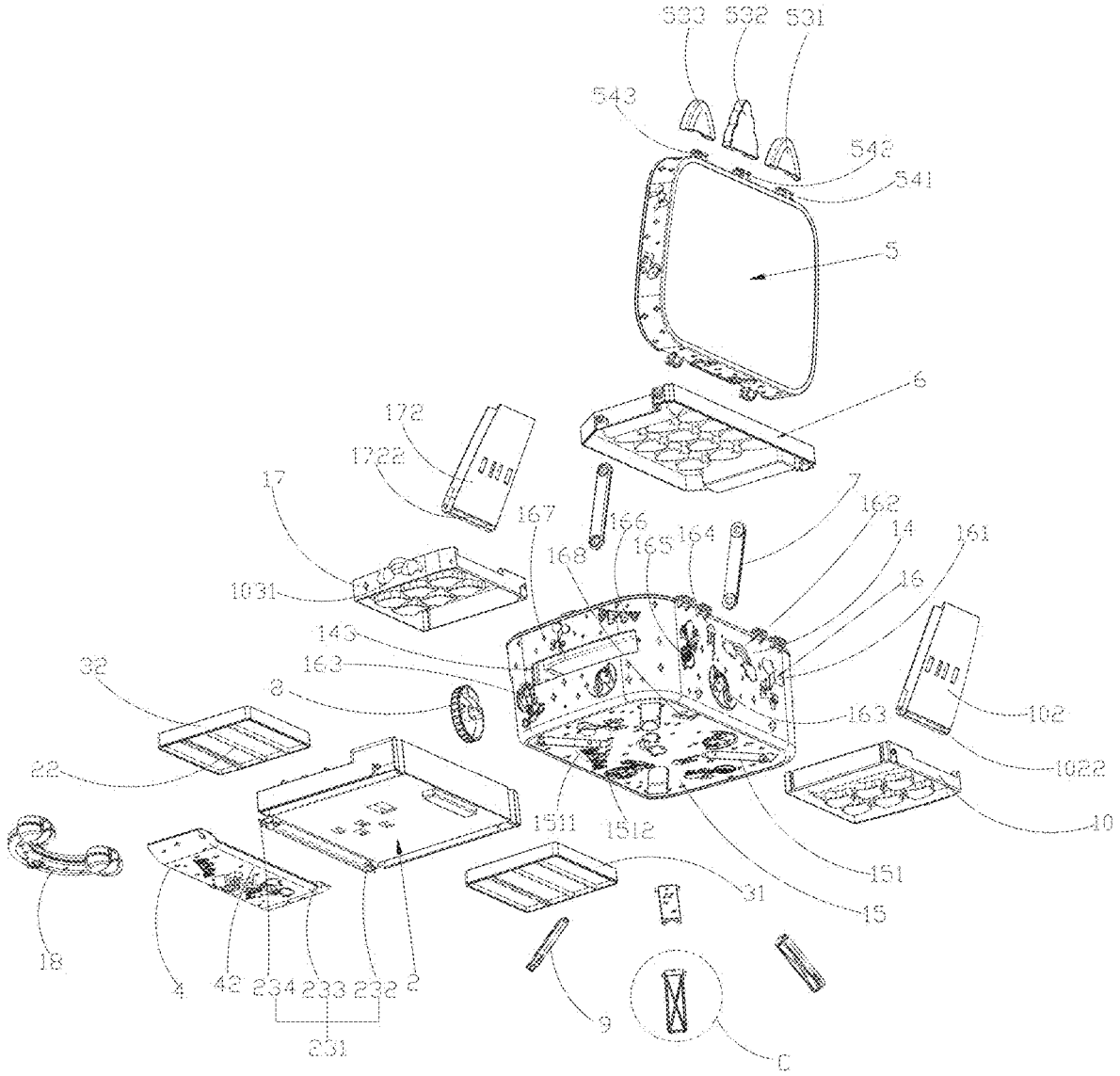
FIG. 2 is an exploded structure diagram of another angle of the present invention.
Figure 3:
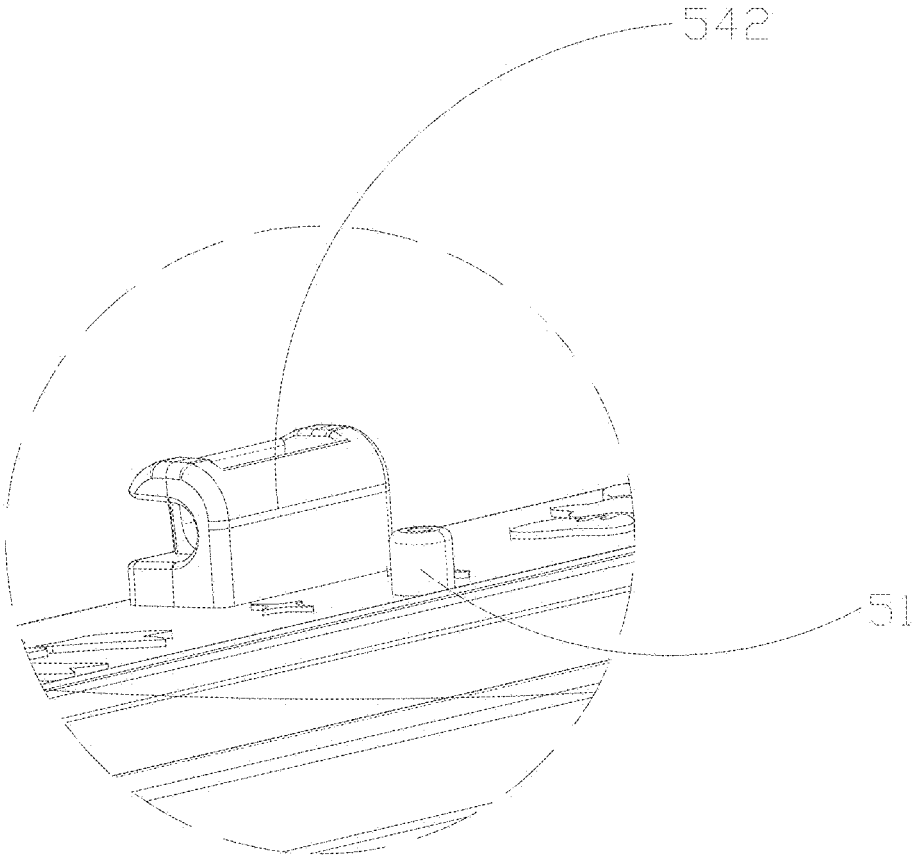
FIG. 3 is an enlarged view of area A in FIG. 1.
Figure 4:
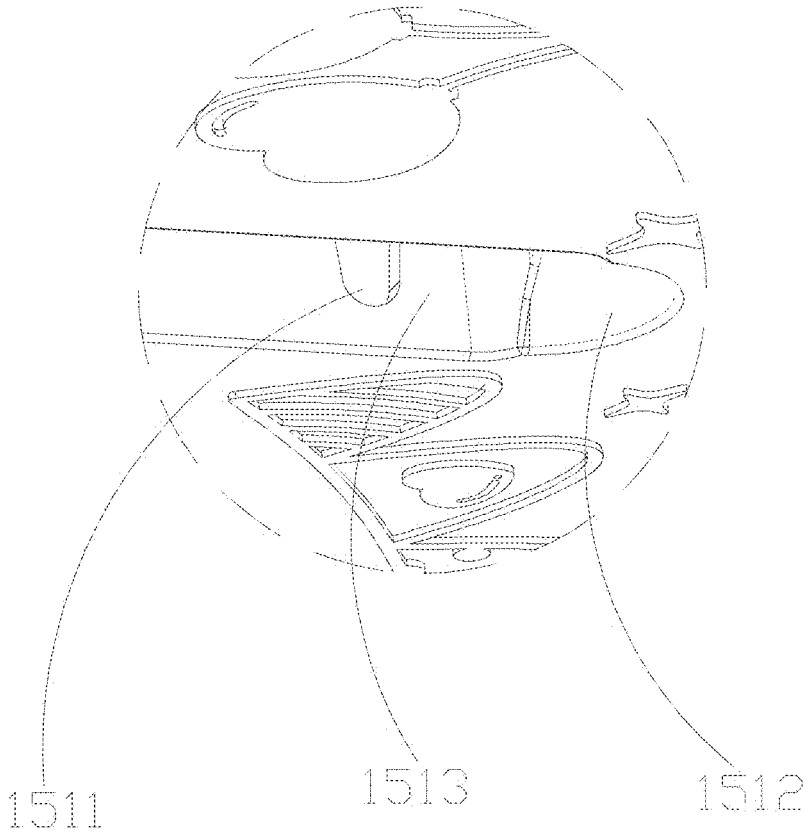
FIG. 4 is an enlarged view of area B in FIG. 1.
Figure 5:
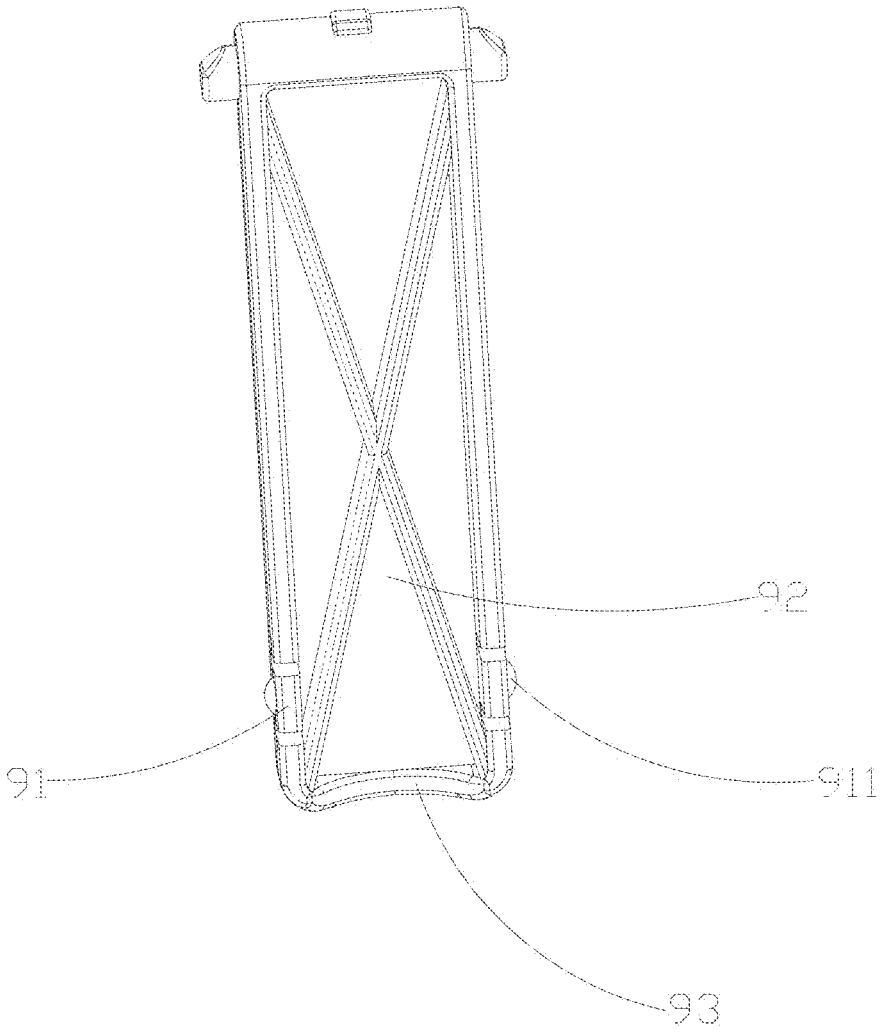
FIG. 5 is an enlarged view of area C in FIG. 2.
Figure 6:
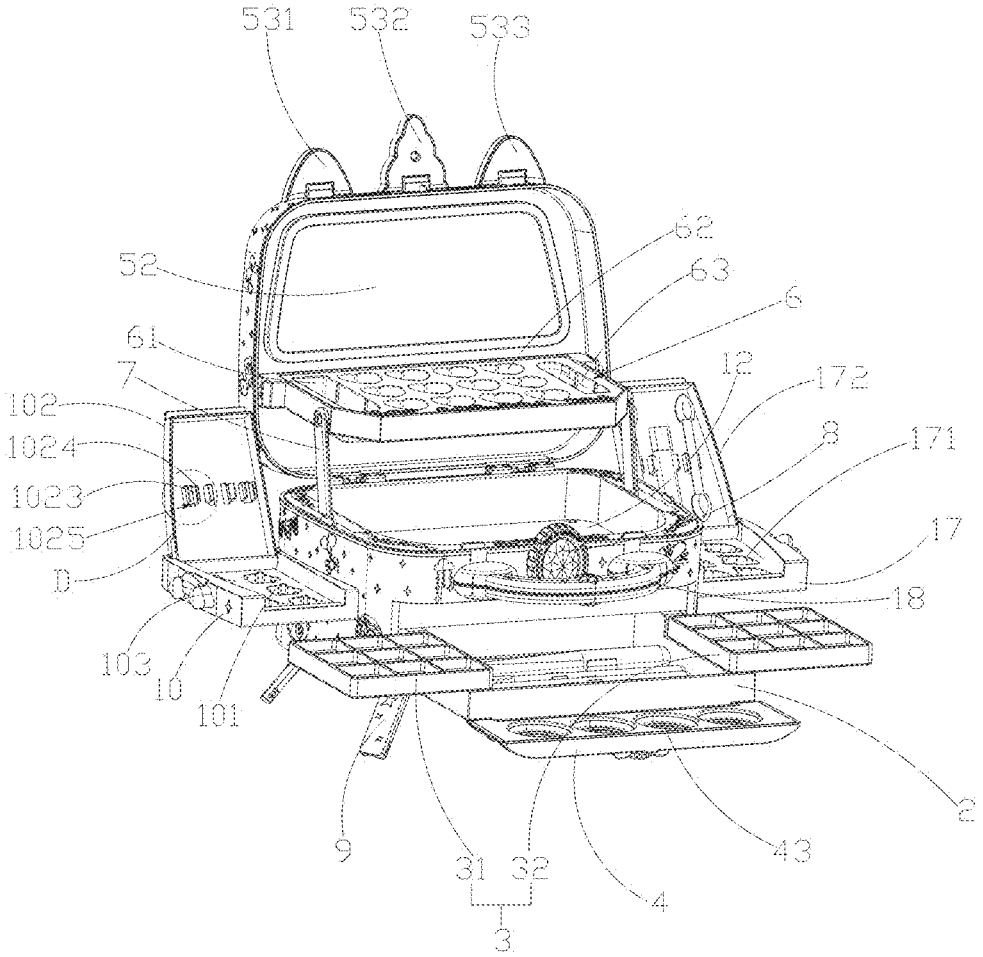
FIG. 6 is an overall structure diagram of the open state of the present invention.
Figure 7:
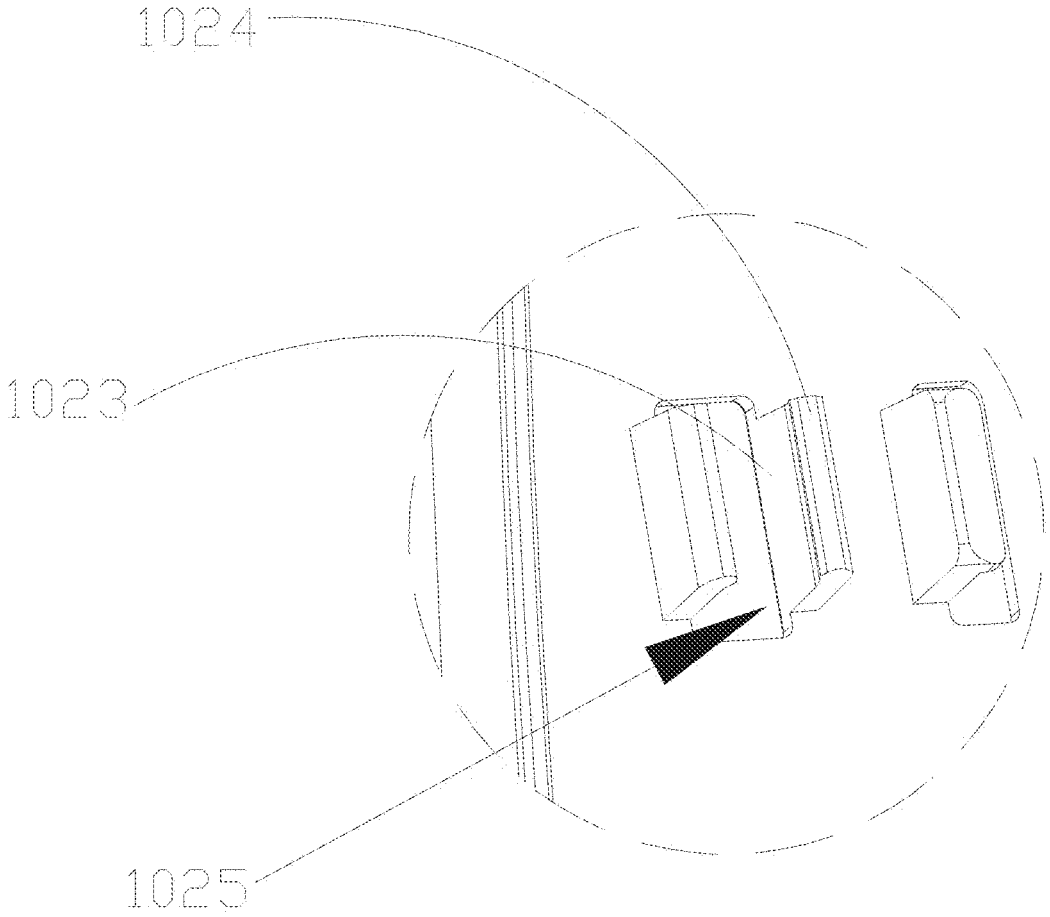
FIG. 7 is an enlarged view of area D in FIG. 6.
Figure 8:
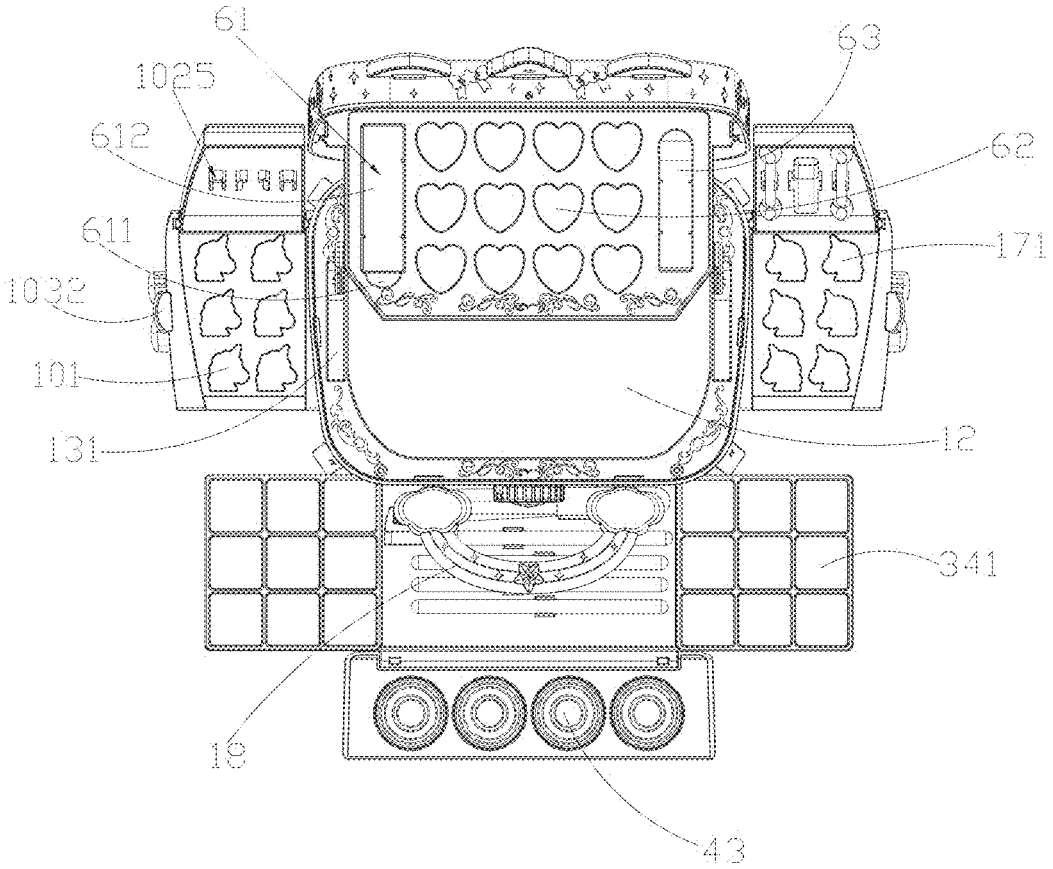
FIG. 8 is an overhead view of the present invention.
Figure 9:
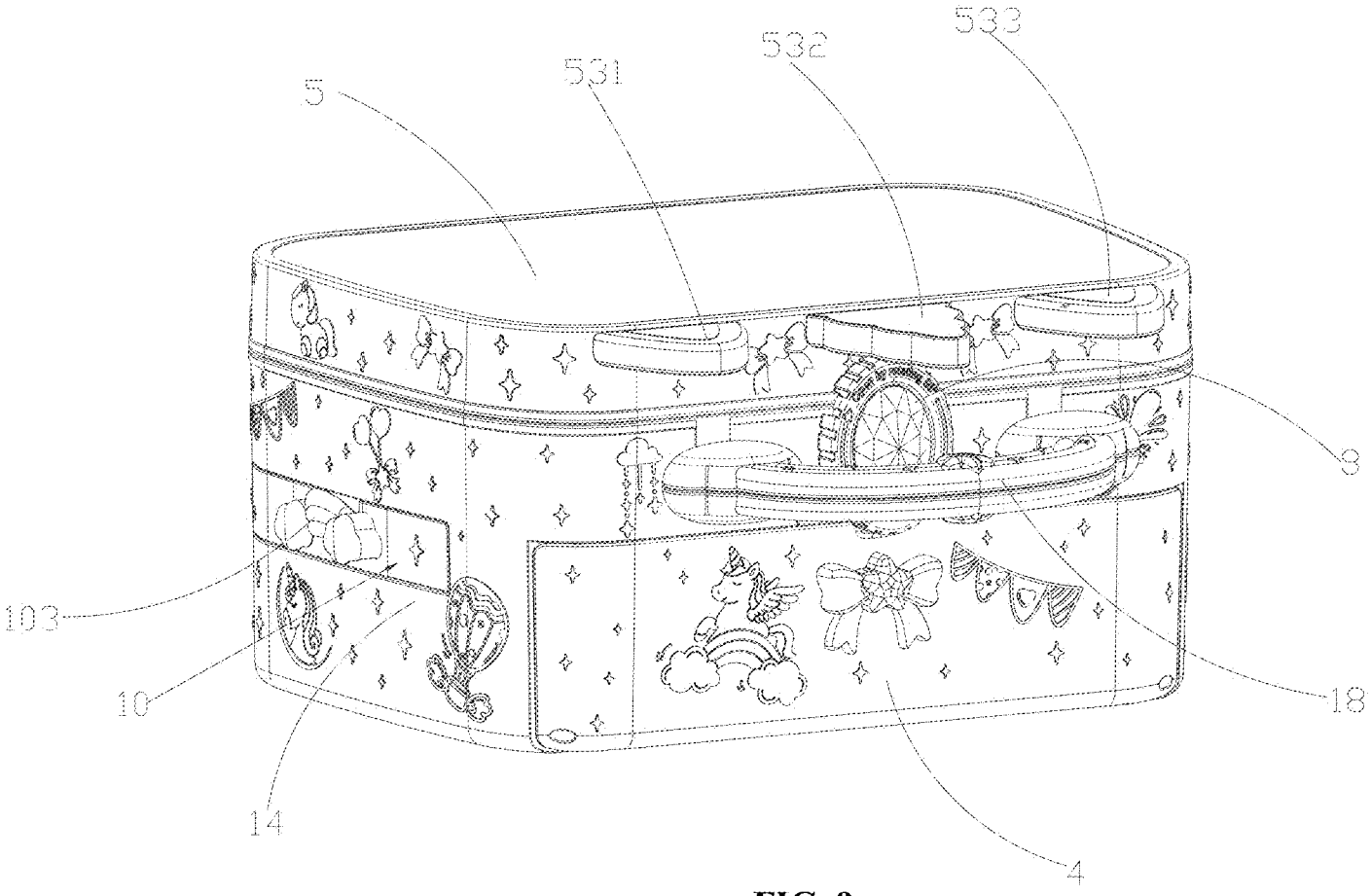
FIG. 9 is an overall structure diagram of the covered state of the present invention.

Referring to FIG. 1 to FIG. 9, the present invention provides a toy cosmetic box. The toy cosmetic box includes a box body 1, and the box body 1 defines an accommodating slot 11. The toy cosmetic box further includes a drawer 2. The drawer 2 is arranged in the accommodating slot 11, and the drawer 2 is slidably connected to the box body 1. The drawer 2 is movable between a storage position and an extended position. The toy cosmetic box further includes a plurality of storage plates 3. Both the storage plates 3 are arranged on an upper surface of the drawer 2. Both the storage plates 3 are movably connected to the drawer 2, and both the storage plates 3 are movable between a first position and a second position. When the drawer 2 is at the extended position, the drawer 2 extends out from the accommodating slot 11, and the storage plates 3 are movable from the first position to the second position. When the storage plates 3 move from the second position to the first position, the drawer 2 is movable from the extended position to the storage position, and the storage plates 3 and the drawer 2 are all positioned in the accommodating slot 11.

Through the arrangement of the above structure, the toy cosmetic box includes the box body 1, and the box body 1 defines the accommodating slot 11. The toy cosmetic box further includes the drawer 2. The drawer 2 is arranged in the accommodating slot 11, and the drawer 2 is slidably connected to the box body 1. The drawer 2 is movable between the storage position and the extended position. The toy cosmetic box further includes the plurality of storage plates 3. Both the storage plates 3 are arranged on the upper surface of the drawer 2. Both the storage plates 3 are movably connected to the drawer 2, and both the storage plates 3 are movable between the first position and the second position. Thus, when the drawer 2 is at the extended position, the drawer 2 extends out from the accommodating slot 11, and the storage plates 3 are movable from the first position to the second position. Moreover, when the storage plates 3 move from the second position to the first position, the drawer 2 is movable from the extended position to the storage position. Thus, the linkage relation between the drawer 2 and the storage plates 3 is established, thereby improving the storage efficiency and operational interest of the toy cosmetic box.

In this embodiment, the storage plates 3 include a first storage plate 31 and a second storage plate 32. The first storage plate 31 and the second storage plate 32 are both arranged on the upper surface of the drawer 2. The first storage plate 31 is slidable along a first side of the drawer 2, and the second storage plate 32 is slidable along a second side of the drawer 2. Through the arrangement of the above structure, the first storage plate 31 is slidable along the first side of the drawer 2, and the second storage plate 32 is slidable along the second side of the drawer 2. Thus, a symmetric arrangement of the two storage plates not only increases the storage capacity, but also makes the entire structure more balanced and beautiful in visual sense. Children can operate the two storage plates respectively, thereby achieving a more flexible spatial combination.

In this embodiment, a plurality of partition plates 33 and a first accommodating slot 34 are arranged on the first storage plate 31 and the second storage plate 32. The partition plates 33 is configured for separating the first accommodating slot 34 into a plurality of storage units 341. Through the arrangement of the above structure, the first storage plate 31 and the second storage plate 32 are provided with the plurality of partition plates 33 and the first accommodating slot 34. The partition plates 33 is configured for separating the first accommodating slot 34 into the plurality of storage units 341. Thus, the design of the partition plates 33 enables small accessories to be stored in categories, thereby avoiding confusion and loss, and cultivating children's arrangement and storage habits at the same time.

In this embodiment, a plurality of slide rail seats 21 are arranged on the drawer 2. Lower portions of the first storage plate 31 and the second storage plate 32 corresponding to the slide rail seats 21 are provided with a slide rail 22. Through the arrangement of the above structure, the drawer 2 are provided with the plurality of slide rail seats 21. Lower portions of the first storage plate 31 and the second storage plate 32 corresponding to the slide rail seats 21 are provided with the slide rail 22. Thus, the slide rail system ensures the sliding stability and accuracy of the storage plates, and extends the service life of the product.

In this embodiment, a storage slot 12 is defined in the box body 1, and the storage slot 12 is configured for storing objects. Through the arrangement of the above structure, the box body 1 is provided with the storage slot 12, and the storage slot 12 is configured for storing objects. Thus, the storage slot 12 is made to provide special storage space for larger objects.

In this embodiment, the box body 1 includes an upper housing 13, a middle housing 14 and a lower housing 15. The accommodating slot 11 is enclosed and formed by the upper housing 13, the middle housing 14 and the lower housing 15. The middle housing 14 is provided with a first accommodating opening 141. The storage slot 12 is defined in the upper housing 13. When the drawer 2 is in the extended position, the drawer 2 is configured for extending out through the first accommodating opening 141. When the drawer 2 is in the storage position, the storage plates 3 and the drawer 2 are all positioned in the accommodating slot 11. Through the arrangement of the above structure, the box body 1 has the design of including the upper housing 13, the middle housing 14 and the lower housing 15. The accommodating slot 11 is enclosed and formed by the upper housing 13, the middle housing 14 and the lower housing 15. The middle housing 14 is provided with a first accommodating opening 141. The storage slot 12 is defined in the upper housing 13. When the drawer 2 is in the extended position, the drawer 2 is configured for extending out through the first accommodating opening 141. In this way, the entire product is enabled to keep the compactness and possess rich functionality.

In this embodiment, an outer side wall of the drawer 2 is provided with a connection portion 23 and a pull handle 4 rotatably connected to the connection portion 23. The connection portion 23 is provided with a hinged structure 231. The pull handle 4 is rotatably connected to the connection portion 23 via the hinged structure 231. The pull handle 4 is capable of switching between a locked state and an unlocked state through rotation. When the pull handle 4 is in the locked state, the pull handle 4 is configured for closing the first accommodating opening 141. When the pull handle 4 is in the unlocked state, the pull handle 4 is capable of opening the first accommodating opening 141. Preferably, the connection portion 23 is arranged and extended along a longitudinal direction of the outer side wall of the drawer 2. The hinged structure 231 includes a hinged seat 232, a hinged sleeve 233 and a hinged shaft 234. The hinged seat 232 is fixedly connected to the connection portion 23. The hinged sleeve 233 is fixedly connected to the pull handle 4, and is configured for corresponding to the hinged seat 232. A first portion of the hinged shaft 234 is connected within the hinged seat 232, and a second portion of the hinged shaft 234 is connected within the hinged sleeve 233, so that the pull handle 4 is capable of rotating around the hinged shaft 234. Thus, when in the locked state, the pull handle 4 is capable of covering the first accommodating opening 141. Moreover, the pull handle 4 is capable of switching between the locked state and the unlocked state through rotation. Thus, the pull handle 4 is not only used as an operating handle of the drawer 2, and the pull handle 4 is also equipped with a function of sealing the opening. When the pull handle 4 is in the locked state, dust is prevented to enter into.

In this embodiment, the pull handle 4 includes a first mating surface 41 and a first stop surface 42. When the pull handle 4 is in the unlocked state, the pull handle 4 is movable between an open position and a closed position. When the pull handle 4 is rotated from the closed position to the open position, the first stop surface 42 is configured for abutting against a bottom surface of the connection portion 23. Moreover, the pull handle 4 is configured for driving the drawer 2 to move to the extended position under an external force action. When the drawer 2 is in the storage position, and the pull handle 4 is rotated from the open position to the closed position, the pull handle 4 is in the locked state, and the first mating surface 41 is configured for abutting against the first accommodating opening 141. Through the arrangement of the above structure, during use, unlock the pull handle 4 firstly to enable the pull handle 4 to rotate from the open position and the closed position. When the first stop surface 42 abuts against a bottom surface of the connection portion 23, the first stop surface 42 is configured for limiting further rotation of the pull handle 4. In this case, the pull handle 4 is capable of driving the drawer 2 to move to the extended position under the external force action. During storage, press the pull handle 4 to enable the drawer 2 to move to the storage position. The pull handle 4 is enabled to rotate from the open position to the closed position, so that the pull handle 4 is in the locked state. Moreover, the first mating surface 41 is configured for abutting against the first accommodating opening 141, so as to ensure the sealing performance.

In this embodiment, the toy cosmetic box further includes a cover body 5. The cover body 5 is movably connected to the upper housing 13, so that the cover body 5 is movable between a covered position and an opened position. When the cover body 5 moves to the covered position, the storage slot 12 is covered by the cover body 5. When the cover body 5 moves to the opened position, the cover body 5 is configured for opening the upper housing 13. Through the arrangement of the above structure, the toy cosmetic box further includes the cover body 5. The cover body 5 is movably connected to the upper housing 13, so that the cover body 5 is movable between the covered position and the opened position. This enables the design of the cover body 5 not only to protect the objects in the toy cosmetic box, but also to provide a definite opening and closing operational interface for users, thereby further enhancing the entirety and aesthetic of the product.

In this embodiment, the pull handle 4 is provided with a plurality of first cosmetic slots 43. The plurality of first cosmetic slots 43 are sequentially spaced apart from a first side of the pull handle 4 to a second side of the pull handle 4. When the pull handle 4 is in the locked state, the first cosmetic slots 43 are positioned in the accommodating slot 11. When the pull handle 4 is in the unlocked state, the first cosmetic slots 43 are configured for moving from the closed position to the open position together with the pull handle 4. Through the arrangement of the above structure, the plurality of first cosmetic slots 43 are sequentially spaced apart from the first side of the pull handle 4 to the second side of the pull handle 4. Thus, a surface space of the pull handle 4 is fully utilized to enhance the storage function. Moreover, the pull handle 4 is not only used as an operating component, but also becomes a functional storage unit, thereby further improving the overall storage efficiency.

In this embodiment, the toy cosmetic box further includes an inner box body 6 and a plurality of linkage rods 7. Both sides on a back end of the inner box body 6 are respectively hinged to inner walls on both sides of the cover body 5. Both sides on a front end of the inner box body 6 are respectively hinged to first ends of the linkage rods 7. Second ends of the linkage rods 7 are respectively hinged to both sides of the upper housing 13. Through the arrangement of the above structure, the linkage rod system realizes a synchronous linkage of the inner box body 6 when the cover body 5 is opened, provides a better use experience, and further increases the operational interest of the product.

In this embodiment, a rotating locking member 8 is arranged on the middle housing 14, and a bulge 51 is formed on the cover body 5. When the cover body 5 is in the covered position, the rotating locking member 8 is capable of moving from the locked state and the unlocked state. When a first end of the rotating locking member 8 is engaged in the bulge 51, the rotating locking member 8 is in the locked state. In addition, a second end of the rotating locking member 8 is configured for abutting against an outer side wall of the pull handle 4, so that the pull handle 4 is kept in the closed position. When the rotating locking member 8 is separated from the bulge 51, the rotating locking member 8 is in the unlocked state, so that the cover body 5 is movable from the covered position to the opened position. Moreover, the pull handle 4 is movable from the closed position to the open position. Through the arrangement of the above structure, the rotating locking member 8 is enabled to realize a unified control of the cover body 5 and the pull handle 4. This ensures the safety of the product in the locked state, and further prevents the children from accidentally opening the toy cosmetic box.

In this embodiment, a cosmetic mirror 52 is arranged in the cover body 5. The cosmetic mirror 52 is positioned over a hinged position between the inner box body 6 and the cover body 5. Through the arrangement of the above structure, the arrangement of the cosmetic mirror 52 increases the simulation and functionality of the product, so that the children can have a more realistic experience in the role play, thereby further cultivating their cognition of beauty and their aesthetic ability.

In this embodiment, a first groove 61, a plurality of second grooves 62 and a third groove 63 are defined on the inner box body 6. The first groove 61 and the third groove 63 are respectively arranged close to both sides of the inner box body 6. The plurality of second grooves 62 are spaced along a longitudinal direction and a transverse direction of the inner box body 6. The second grooves 62 are arranged between the first groove 61 and the third groove 63. Through the arrangement of the above structure, the first groove 61, the plurality of second grooves 62 and the third groove 63 are capable of providing special positioning storage positions for various simulated make-up appliances. This realizes a refined classified storage, and improves the accuracy and convenience of taking objects.

In this embodiment, the lower housing 15 is provided with a plurality of support feet 9. The lower housing 15 is provided with a plurality of second accommodating slots 151. The second accommodating slots 151 are arranged along a plurality of corners of the lower housing 15. All the support feet 9 are movably connected to one end of the second accommodating slot 151. All the support feet 9 are movable between a supporting position and a folded position. When the support feet 9 are all in the supporting positions, the support feet 9 are all configured for supporting the box body 1. When the support feet 9 are all in the folded positions, all the support feet 9 are capable of moving into the second accommodating slots 151. Through the arrangement of the above structure, the design of the folding support feet 9 not only ensures the stability during use, but also ensures the compactness during storage, thereby improving the portability of the product. The distribution design at the four corners of the support feet 9 provides a balanced and stable support for the entire box body 1, which prevents toppling or sliding during use.

In this embodiment, the support foot 9 is provided with an elastic wall 91 and a protrusion 911 positioned on the elastic wall 91. A slot 1511 is defined on an inner wall of the second accommodating slot 151, and the protrusion 911 is engaged in the slot 1511. The support foot 9 is further provided with a hollow groove 92 and a first finger slot 93. The first finger slot 93 is in communication with the hollow groove 92. The second accommodating slot 151 is equipped with a second finger slot 1512 and a first inner slot 1513. The second finger slot 1512 is in communication with the first inner slot 1513. When the support foot 9 is in the folded position, the second finger slot 1512 and the first finger slot 93 are in cooperation with each other to make the support foot 9 move from the folded position to the supporting position. Through the arrangement of the above structure, a clamped connection structure ensures the stability of the support feet 9 in the folded state, and prevents the accidental extension during the carrying process. The corresponding matching design of the finger slots provide users with a convenient operating grip point, so that the unfolding and folding operations of the support feet 9 are simple and easy. The design of the elastic wall 91 increases the hand feeling of operation and the accuracy of positioning.

In this embodiment, the middle housing 14 is further provided with a second accommodating opening 142 and a first accommodating box 10. The first accommodating box 10 is capable of switching between a first extended state and a first storage state. When the first accommodating box 10 is moved to the first extended state, the first accommodating box 10 is configured for extending out from the second accommodating opening 142. When the first accommodating box 10 is moved to the first storage state, the first accommodating box 10 is positioned in the accommodating slot 11. Through the arrangement of the above structure, the stretchable design of the first accommodating box 10 greatly increases the flexibility of product storage. When not in use, the first accommodating box 10 can be completely concealed inside the middle housing 14, to maintain the compactness of the product. When in need, the first accommodating box 10 can be quickly expanded to provide additional storage space, which effectively improves the utility rate of space and the convenience of using the product.

In this embodiment, the first accommodating box 10 is provided with a plurality of second cosmetic slots 101 and a first protective cover 102. The plurality of second cosmetic slots 101 are sequentially arranged along a longitudinal direction and a transverse direction of the first accommodating box 10. The first protective cover 102 includes a second mating surface 1021 and a second stop surface 1022. The first protective cover 102 is movably connected to the first accommodating box 10. When the first protective cover 102 covers the second cosmetic slots 101, the second mating surface 1021 is attached to the second cosmetic slots 101. When the second stop surface 1022 abuts against a side wall of the first accommodating box 10, the second cosmetic slots 101 are opened by the first protective cover 102. Through the arrangement of the above structure, the design of the first protective cover 102 provides effective protection for objects in the second cosmetic slots 101, thereby preventing dust from entering into and preventing objects from scattering. The precise fitting design of the second mating surface 1021 ensures a good sealing effect. The limiting function of the second stop surface 1022 ensures the stability when the protective cover is opened. The arrangement design of the plurality of cosmetic slots realizes the classified storage of small objects.

In this embodiment, a plurality of decorative buckles 53 are arranged on the cover body 5. A side wall of the cover body 5 extends outward to form a plurality of flanges 54. The plurality of decorative buckles 53 are respectively hinged on the flanges 54. The decorative buckles 53 are movable between a decorative position and a fastened position. When the decorative buckles 53 are in the decorative positions, the decorative buckles 53 are configured for decorating the cover body 5. When the decorative buckles 53 are in the fastened positions, the decorative buckles 53 are capable of stacking on the side wall of the cover body 5. Through the arrangement of the above structure, the decorative buckles 53 not only increase the aesthetic of the product, but also provide additional operational interest for children and cultivates their operational ability. When the decorative buckles 53 are in the decorative positions, an exquisite appearance of the product is showed. When the decorative buckles 53 are in the fastened positions, a compact storage is achieved. This embodies a perfect combination of aesthetic and practicality.

In this embodiment, the decorative buckles 53 include a first decorative buckle 531, a second decorative buckle 532 and a third decorative buckle 533. The flanges 54 include a first flange 541, a second flange 542 and a third flange 543. The first flange 541 and the third flange 543 are respectively positioned on both sides of the cover body 5. The second flange 542 is positioned between the first flange 541 and the third flange 543. The first decorative buckle 531 is hinged on the first flange 541, and the first decorative buckle 531 is rotatable relative to the cover body 5. The second decorative buckle 532 is hinged on the second flange 542, and the second decorative buckle 532 is rotatable relative to the cover body 5. The third decorative buckle 533 is hinged on the third flange 543, and the third decorative buckle 533 is rotatable relative to the cover body 5. A shape of the second decorative buckle 532 is different from a shape of the first decorative buckle 531 and a shape of the third decorative buckle 533. Through the arrangement of the above structure, the distribution design of the three decorative buckles is configured for realizing a balanced decorative effect of the cover body 5. The first decorative buckle 531 and the third decorative buckle 533 are in cat-ear shapes design. The second decorative buckle 532 is in a tree shape design. Each decorative buckle is capable of independently rotating, which provides more operation changes and game fun for children, and cultivates children's precise operational ability.

In this embodiment, the middle housing 14 and the lower housing 15 are both provided with protruding decorative patterns 16. The decorative patterns 16 are equipped with a first decorative unit 161, a second decorative unit 162, a third decorative unit 163, a fourth decorative unit 164, a fifth decorative unit 165, a sixth decorative unit 166, a seventh decorative unit 167, and an eighth decorative unit 168. Through the arrangement of the above structure, the plentiful decorative patterns 16 not only increase the visual attraction of the product, but also enhance the touching experience, thereby providing children with multi-sensory gaming experience. The eight decorative units together form a complex and beautiful decorative pattern. At the same time, the protruding design enhances the interactive experience and improves the practicality of the product.

In this embodiment, the middle housing 14 is further provided with a third accommodating opening 143 and a second accommodating box 17. The second accommodating box 17 is capable of switching between a second extended state and a second storage state. When the second accommodating box 17 is moved to the second extended state, the second accommodating box 17 is configured for extending out from the third accommodating opening 143. When the second accommodating box 17 is moved to the second storage state, the second accommodating box 17 is positioned in the accommodating slot 11. The second accommodating box 17 is further provided with a plurality of third cosmetic slots 171 and a second protective cover 172. The plurality of third cosmetic slots 171 are sequentially arranged along a longitudinal direction and a transverse direction of the second accommodating box 17. The second protective cover 172 includes a third mating surface 1721 and a third stop surface 1722. The second protective cover 172 is movably connected to the second accommodating box 17. When the second protective cover 172 covers the third cosmetic slots 171, the third mating surface 1721 is attached to the third cosmetic slots 171. When the third stop surface 1722 abuts against a side wall of the second accommodating box 17, the third cosmetic slots 171 are opened by the second protective cover 172. Through the arrangement of the above structure, the symmetrical design between the second accommodating box 17 and the first accommodating box 10 realizes a further expansion of storage space, thereby providing users with more selections for classified storage. The design of the second protective cover 172 ensures the safety of the objects, and an overall symmetrical layout enhances the aesthetic of the product.

In this embodiment, a plurality of clamping walls 1023 and a plurality of clamping hooks 1024 are arranged on the first protective cover 102 and the second protective cover 172. A clamping slot 1025 is formed between the clamping wall 1023 and the clamping hook 1024. The clamping hooks 1024 are configured for clamping the objects in the clamping slots 1025. Through the arrangement of the above structure, the clamping mechanism provides a stable fixing function for small cosmetic appliances. The clamping walls 1023 serve as supporting surfaces, and the clamping hooks 1024 provide clamping forces, so that the objects are limited in the clamping slots 1025, thereby increasing the practicality of the product.

In this embodiment, protruding handles 103 are arranged on the first accommodating box 10 and the second accommodating box 17. The handles 103 are provided with lightening slots 1031 and finger grip apertures 1032. The finger grip apertures 1032 are configured for gripping the handles 103. Through the arrangement of the above structure, the handles 103 provide convenient gripping points for users to operate the the first accommodating box 10 and the second accommodating box 17. The design of the lightening slots 1031 ensures strength while reducing weight. Moreover, the user-friendly design of the finger grip apertures 1032 enables children to easily grasp and operate, thereby improving the usability and safety of the product.

In this embodiment, a plurality of third accommodating slots 131 are arranged on the upper housing 13. The plurality of third accommodating slots 131 are positioned on both sides of the upper housing 13. Both sides on the front end of the inner box body 6 are respectively hinged to the first ends of the linkage rods 7, and the second ends of the linkage rods 7 are respectively hinged to an inner wall of the third accommodating slots 131. Through the arrangement of the above structure, the third accommodating slots 131 provide a stable installation foundation and storage space for the linkage rods 7. This ensures the stable operation of the linkage mechanism. At the same time, the design of the accommodating slots maintains the tidiness of the appearance when the linkage rods are stored. The distribution design of the plurality of accommodating slots realizes an even dispersion of the force, and improves the stability of the overall structure.

In this embodiment, a first groove 61 is provided with a third finger slot 611 and a second inner slot 612. The third finger slot 611 is in communication with the second inner slot 612. A shape of the first groove 61, a shape of a second groove 62 and a shape of a third groove 63 are different. Through the arrangement of the above structure, the third finger slot 611 provides users with an operation space convenient for grasping objects. The connected design between the third finger slot 611 and the second inner slot 612 makes the taking operation more convenient. Moreover, the groove design in different shapes not only meets the storage needs of various objects, but also increases the visual hierarchy of the product, thereby providing an educational function of shape recognition for children.

In this embodiment, a lifting handle 18 is arranged on a side wall of the middle housing 14. Through the arrangement of the above structure, the design of the lifting handle 18 greatly improves the portability of the product. This facilitates children to lift and move the entire toy cosmetic box, and the position design of the lifting handle 18 ensures the balance during lifting.

The above description only describes embodiments of the present disclosure, and is not intended to limit the present disclosure; various modifications and changes can be made to the present disclosure. Any modifications, equivalent substitutions, and improvements made within the spirit and scope of the present disclosure are intended to be included within the scope of the present disclosure.

What is claimed is:

1. A toy cosmetic box, comprising:

a box body, the box body defining an accommodating slot;

a drawer, the drawer being arranged in the accommodating slot, and the drawer being slidably connected to the box body; the drawer being movable between a storage position and an extended position;

a plurality of storage plates, all the storage plates being arranged on an upper surface of the drawer, all the storage plates being movably connected to the drawer, and all the storage plates being movable between a first position and a second position, wherein when the drawer is at the extended position, the drawer extends out from the accommodating slot, the storage plates are movable from the first position to the second position; when the storage plates move from the second position to the first position, the drawer is movable from the extended position to the storage position, and the storage plates and the drawer are all positioned in the accommodating slot;

wherein the box body comprises an upper housing, a middle housing and a lower housing; the accommodating slot is enclosed and formed by the upper housing, the middle housing and the lower housing, the middle housing is provided with a first accommodating opening;

wherein an outer side wall of the drawer is provided with a connection portion and a pull handle hinged to the connection portion, the pull handle is capable of switching between a locked state and an unlocked state, and when the pull handle is in the locked state, the pull handle is configured for closing the first accommodating opening; when the pull handle is in the unlocked state, the pull handle is capable of opening the first accommodating opening;

wherein the toy cosmetic box further comprises a cover body, the cover body is movably connected to the upper housing, so that the cover body is movable between a covered position and an opened position;

wherein a rotating locking member is provided on the middle housing, a bulge is formed on the cover body, when the cover body is in the covered position, the rotating locking member is movable between the locked state and the unlocked state, when a first end of the rotating locking member is engaged in the bulge, the rotating locking member is in the locked state, and a second end of the rotating locking member is in contact with an outer side wall of the pull handle, so that the pull handle is kept in the closed position; when the rotating locking member is separated from the bulge, the rotating locking member is in the unlocked state, so that the cover body is movable from the covered position to the opened position, and the pull handle is movable from the closed position to the open position.

2. The toy cosmetic box according to claim 1, wherein the storage plates comprise a first storage plate and a second storage plate, the first storage plate and the second storage plate are both arranged on the upper surface of the drawer, the first storage plate is slidable along a first side of the drawer, and the second storage plate is slidable along a second side of the drawer.

3. The toy cosmetic box according to claim 2, wherein a plurality of partition plates and a first accommodating slot are arranged on the first storage plate and the second storage plate, and the partition plate is configured for separating the first accommodating slot into a plurality of storage units.

4. The toy cosmetic box according to claim 2, wherein a plurality of slide rail seats are arranged on the drawer, and lower portions of the first storage plate and the second storage plate corresponding to the slide rail seats are provided with a slide rail.

5. The toy cosmetic box according to claim 1, wherein a storage slot is defined in the box body, and the storage slot is configured for storing objects.

6. The toy cosmetic box according to claim 5, wherein the storage slot is defined in the upper housing, when the drawer is in the extended position, the drawer is configured for extending out through the first accommodating opening, and when the drawer is in the storage position, the storage plates and the drawer are all positioned in the accommodating slot.

7. The toy cosmetic box according to claim 1, wherein the pull handle comprises a first mating surface and a first stop surface, when the pull handle is in the unlocked state, the pull handle is movable between an open position and a closed position, when the pull handle is rotated from the closed position to the open position, the first stop surface is in contact with a bottom surface of the connection portion, and the pull handle is configured for driving the drawer to move to the extended position under an external force action, when the drawer is in the storage position, and the pull handle is rotated from the open position to the closed position, the pull handle is in the locked state, and the first mating surface is in contact with the first accommodating opening.

8. The toy cosmetic box according to claim 1, wherein when the cover body moves to the covered position, the storage slot is covered by the cover body; when the cover body moves to the opened position, the upper housing is opened by the cover body.

9. The toy cosmetic box according to the claim 7, wherein the pull handle is provided with a plurality of first cosmetic slots, the first cosmetic slots are spaced along a longitudinal direction of the pull handle, and when the pull handle is in the locked state, the first cosmetic slots are positioned in the accommodating slot; when the pull handle is in the unlocked state, the first cosmetic slots are configured for moving from the closed position to the open position together with the pull handle.

10. The toy cosmetic box according to claim 8, wherein the toy cosmetic box further comprises an inner box body and a plurality of linkage rods, both sides on a back end of the inner box body are respectively hinged to inner walls on both sides of the cover body, both sides on a front end of the inner box body are respectively hinged to first ends of the linkage rods, and second ends of the linkage rods are respectively hinged to both sides of the upper housing.

11. The toy cosmetic box according to claim 10, wherein a cosmetic mirror is provided in the cover body, and the cosmetic mirror is positioned over a hinged position between the inner box body and the cover body.

12. The toy cosmetic box according to claim 10, wherein a first groove, a plurality of second grooves and a third groove are defined on the inner box body, the first groove and the third groove are respectively arranged close to both sides of the inner box body, the plurality of second grooves are spaced along a longitudinal direction and a transverse direction of the inner box body, and the second grooves are arranged between the first groove and the third groove.

13. The toy cosmetic box according to claim 6, wherein the lower housing is provided with a plurality of support feet, the lower housing is provided with a plurality of second accommodating slots, the second accommodating slots are arranged along a plurality of corners of the lower housing, all the support feet are movably connected to one end of the second accommodating slot, all the support feet are movable between a supporting position and a folded position, when the support feet are all in the supporting positions, the support feet are all configured for supporting the box body, and when the support feet are all in the folded positions, all the support feet are capable of moving into the second accommodating slots.

14. The toy cosmetic box according to claim 13, wherein each of the support feet is provided with an elastic wall and a protrusion positioned on the elastic wall, a slot is defined on an inner wall of each of the second accommodating slots, and the protrusion is engaged in the slot; each of the support feet is further provided with a hollow groove and a first finger slot, and the first finger slot is in communication with the hollow groove; each of the second accommodating slots is equipped with a second finger slot and a first inner slot, the second finger slot is in communication with the first inner slot, when each of the support feet is in the folded position, the second finger slot and the first finger slot are in cooperation with each other to make each of the support feet move from the folded position to the supporting position.

15. The toy cosmetic box according to claim 6, wherein the middle housing is further provided with a second accommodating opening and a first accommodating box, the first accommodating box is capable of switching between an extended state and a storage state, when the first accommodating box is moved to the extended state, the first accommodating box is configured for extending out from the second accommodating opening, and when the first accommodating box is moved to the storage state, the first accommodating box is positioned in the accommodating slot.

16. The toy cosmetic box according to claim 15, wherein the first accommodating box is provided with a plurality of second cosmetic slots and a first protective cover, the plurality of second cosmetic slots are sequentially arranged along a longitudinal direction and a transverse direction of the first accommodating box, the first protective cover comprises a second mating surface and a second stop surface, the first protective cover is movably connected to the first accommodating box, when the first protective cover covers the second cosmetic slots, the second mating surface is attached to the second cosmetic slots, and when the second stop surface is in contact with a side wall of the first accommodating box, the second cosmetic slots are opened by the first protective cover.

17. The toy cosmetic box according to claim 8, wherein a plurality of decorative buckles are arranged on the cover body, a side wall of the cover body extends outward to form a plurality of flanges, the plurality of decorative buckles are respectively hinged on the flanges, the decorative buckles are movable between a decorative position and a fastened position, when the decorative buckles are in the decorative positions, the decorative buckles are configured for decorating the cover body, and when the decorative buckles are in the fastened positions, the decorative buckles are capable of being arranged sequentially on the side wall of the cover body.

18. The toy cosmetic box according to the claim 17, wherein the decorative buckles comprise a first decorative buckle, a second decorative buckle and a third decorative buckle, the flanges comprise a first flange, a second flange and a third flange, the first flange and the third flange are respectively positioned on both sides of the cover body, the second flange is positioned between the first flange and the third flange, the first decorative buckle is hinged on the first flange, the first decorative buckle is rotatable relative to the cover body, the second decorative buckle is hinged on the second flange, the second decorative buckle is rotatable relative to the cover body, the third decorative buckle is hinged on the third flange, and the third decorative buckle is rotatable relative to the cover body; a shape of the second decorative buckle is different from a shape of the first decorative buckle and a shape of the third decorative buckle.

* * * * *